US012268235B2

(12) United States Patent
Han

(10) Patent No.: US 12,268,235 B2
(45) Date of Patent: Apr. 8, 2025

(54) APPARATUS AND METHOD FOR MANUFACTURING CUT RECONSTITUTED TOBACCOS

(71) Applicant: KT&G CORPORATION, Daejeon (KR)

(72) Inventor: Dae Nam Han, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 622 days.

(21) Appl. No.: 16/647,138

(22) PCT Filed: May 8, 2019

(86) PCT No.: PCT/KR2019/005469
§ 371 (c)(1),
(2) Date: Mar. 13, 2020

(87) PCT Pub. No.: WO2019/240376
PCT Pub. Date: Dec. 19, 2019

(65) Prior Publication Data

US 2021/0120860 A1 Apr. 29, 2021

(30) Foreign Application Priority Data

Jun. 11, 2018 (KR) ..... 10-2018-0067034

(51) Int. Cl.
*A24B 3/14* (2006.01)
*A24B 3/12* (2006.01)
(Continued)

(52) U.S. Cl.
CPC ..... *A24B 3/14* (2013.01); *A24B 3/12* (2013.01); *A24B 7/14* (2013.01); *A24B 15/28* (2013.01)

(58) Field of Classification Search
CPC ..... A24B 3/14; A24B 3/12
See application file for complete search history.

(56) References Cited

U.S. PATENT DOCUMENTS 3,084,697 A 4/1963 Eissmann
3,817,258 A * 6/1974 Ernow ..... A24B 3/12 131/300
(Continued)

FOREIGN PATENT DOCUMENTS

CN 87103233 A 11/1987
CN 108135247 A 6/2018
(Continued)

OTHER PUBLICATIONS

Extended European Search Report dated Feb. 17, 2022 in European Application No. 19818816.1.
(Continued)

*Primary Examiner* — Christopher M Rodd
*Assistant Examiner* — Jennifer A Kessie
(74) *Attorney, Agent, or Firm* — Sughrue Mion, PLLC

(57) ABSTRACT

Disclosed is an apparatus for manufacturing cut reconstituted tobacco, the apparatus being based on a method whereby: a flavoring solution is supplied on an initial reconstituted tobacco sheet by using a flavoring apparatus; a plurality of intermediate reconstituted tobacco sheets are manufactured by cutting the initial reconstituted tobacco sheet using a primary cutter, a plurality of reconstituted tobacco strands are manufactured by cutting the plurality of intermediate reconstituted tobacco sheets in the longitudinal direction using a plurality of secondary cutters; and a plurality of pieces of cut reconstituted tobacco are manufactured by cutting the plurality of reconstituted tobacco strands in the transverse direction using a plurality of tertiary cutters.

10 Claims, 11 Drawing Sheets

(51) Int. Cl.
*A24B 7/14* (2006.01)
*A24B 15/28* (2006.01)

(56) References Cited

U.S. PATENT DOCUMENTS

| | | | |
|---|---|---|---|
| 4,889,143 | A | 12/1989 | Pryor et al. |
| 4,977,908 | A | 12/1990 | Luke |
| 6,595,216 | B1 | 7/2003 | Wessinger |
| 8,839,801 | B2 | 9/2014 | Miyazawa et al. |
| 9,833,016 | B2 | 12/2017 | Gindrat et al. |
| 10,834,956 | B2 | 11/2020 | Rosado |
| 2018/0116274 | A1 | 5/2018 | Zuchuat et al. |
| 2018/0368465 | A1 | 12/2018 | Rosado |

FOREIGN PATENT DOCUMENTS

| | | | |
|---|---|---|---|
| CN | 108135248 | A | 6/2018 |
| JP | 7-265043 | A | 10/1995 |
| JP | 3206857 | B2 * | 9/2001 |
| KR | 1019900002029 | B1 | 3/1990 |
| KR | 10-1293345 | B1 | 8/2013 |
| KR | 101679531 | B1 | 11/2016 |
| KR | 10-2018-0013865 | A | 2/2018 |
| WO | 2016/193147 | A1 | 12/2016 |
| WO | 2016/203518 | A1 | 12/2016 |
| WO | 2017/089545 | A1 | 6/2017 |

OTHER PUBLICATIONS

Korean Office Action for 10-2018-0067034 dated Jan. 2, 2020.
International Search Report for PCT/KR2019/005469 dated Aug. 12, 2019 (PCT/ISA/210).
Office Action issued Aug. 4, 2021 in Chinese Application No. 201980004525.3.

* cited by examiner

APPARATUS AND METHOD FOR MANUFACTURING CUT RECONSTITUTED TOBACCOS

CROSS REFERENCE TO RELATED APPLICATIONS

This application is a National Stage of International Application No. PCT/KR2019/005469 filed May 8, 2019, claiming priority based on Korean Patent Application No. 10-2018-0067034, filed Jun. 11, 2018.

TECHNICAL FIELD

The present disclosure relates to an apparatus and method for manufacturing cut reconstituted tobacco.

BACKGROUND ART

Recently, in addition to tobacco leaves, reconstituted tobacco leaves have been used for the production of tobacco products. Reconstituted tobacco leaves are usually manufactured from parts of tobacco plants, such as tobacco stems or tobacco powder, that are less suitable for the production of cut fillers. In general, tobacco powder is produced as a byproduct during a manufacturing process of tobacco leaves.

Common forms of reconstituted tobacco are reconstituted tobacco sheets or cast leaves. In a process of forming reconstituted tobacco sheets, tobacco powder and a binder are mixed to form a slurry, a tobacco web is created using the slurry, and a viscous slurry is casted onto a moving metal belt to manufacture a cast leaf. Alternatively, a slurry having low viscosity and high moisture content can be used to manufacture reconstituted tobacco in a process similar to a papermaking process.

The reconstituted tobacco sheets can be cut to manufacture cut reconstituted tobacco. The cut reconstituted tobacco may be generated by finely chopping reconstituted tobacco sheets. When the reconstituted tobacco sheets are compressed to manufacture cut reconstituted tobacco, the density of the reconstituted tobacco sheets is increased, so the reconstituted tobacco sheets have hard pad forms, which makes it difficult to manufacture the cut reconstituted tobacco having suitable characteristics when the reconstituted tobacco sheets are cut.

Accordingly, a method of effectively manufacturing cut reconstituted tobacco from reconstituted tobacco sheets is required.

DESCRIPTION OF EXEMPLARY EMBODIMENTS

Technical Problem

Provided is an apparatus and method for manufacturing cut reconstituted tobaccos, whereby cut reconstituted tobaccos is manufactured from reconstituted tobacco sheets by sequentially cutting the reconstituted tobacco sheets using a plurality of cutters. A technical problem to be achieved according to one or more exemplary embodiments is not limited to the above-described technical problem, and other technical problems may be inferred from the following exemplary embodiments.

Solution to Problem

Provided is an apparatus for manufacturing cut reconstituted tobacco, the apparatus being based on a method whereby: a flavoring solution is supplied on an initial reconstituted tobacco sheet by using a flavoring apparatus; a plurality of intermediate reconstituted tobacco sheets are manufactured by cutting the initial reconstituted tobacco sheet using a primary cutter, a plurality of reconstituted tobacco strands are manufactured by cutting the plurality of intermediate reconstituted tobacco sheets in the longitudinal direction using a plurality of secondary cutters; and a plurality of pieces of cut reconstituted tobacco are manufactured by cutting the plurality of reconstituted tobacco strands in a transverse direction using a plurality of tertiary cutters.

Advantageous Effects of Disclosure

According to the present disclosure, in order for reconstituted tobacco strands manufactured from a reconstituted tobacco sheet supplied via a feed roller to have uniform quality, first, the initial reconstituted tobacco sheet is cut into a plurality of intermediate reconstituted tobacco sheets having smaller widths using the primary cutter and then each of the intermediate reconstituted tobacco sheets is cut in the longitudinal direction using the secondary cutters, so that a plurality of reconstituted tobacco strands may be manufactured.

In addition, a plurality of secondary cutters are used so that, even when some of the secondary cutters have a defect, a process may be performed using the remaining secondary cutter without stopping the process.

Also, a flavoring solution for secondary flavoring (top flavoring) is supplied onto the initial reconstituted tobacco sheet using a flavoring apparatus, thereby preventing the material for secondary flavoring (top flavoring) from being thermally deformed or lost.

Furthermore, a plurality of pieces of cut reconstituted tobacco manufactured from a plurality of apparatuses for manufacturing cut reconstituted tobacco may be mixed using a plurality of conveyor units having different moving directions without using an additional blending device.

BEST MODE

Figure 1:
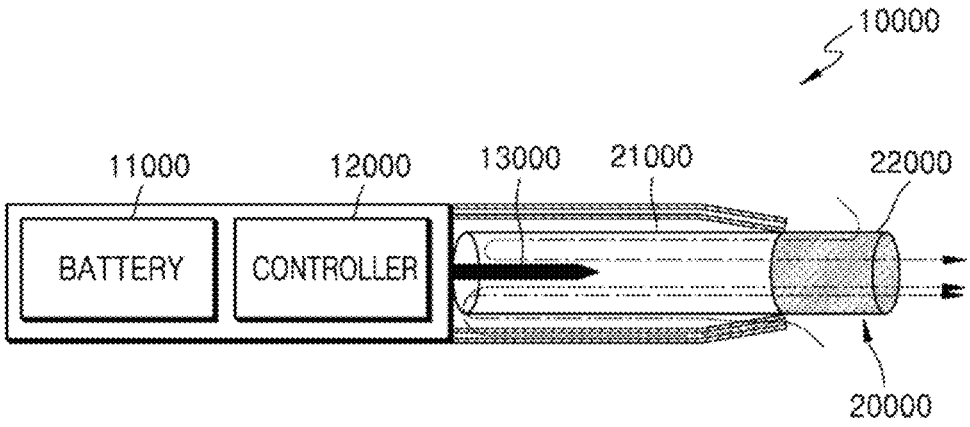
FIGS. 1 through 3 are diagrams showing examples in which a cigarette is inserted into an aerosol generating device.

As a technical means for achieving the above-described technical problem, according to a first aspect of the present disclosure, a method of manufacturing cut reconstituted tobacco, includes supplying an initial reconstituted tobacco sheet; supplying a flavoring solution onto the initial reconstituted tobacco sheet using a flavoring apparatus; manufacturing a plurality of intermediate reconstituted tobacco sheets by cutting the initial reconstituted tobacco sheet using a primary cutter; manufacturing a plurality of reconstituted tobacco strands by cutting the plurality of intermediate reconstituted tobacco sheets in a longitudinal direction using a plurality of secondary cutters that are arranged downstream of the primary cutter and spaced apart from one another by a certain distance; and manufacturing a plurality of pieces of cut reconstituted tobaccos by cutting the plurality of reconstituted tobacco strands in a transverse direction using a plurality of tertiary cutters arranged downstream of each of the plurality of secondary cutters.

The flavoring apparatus may include a flavoring nozzle located above or under the initial reconstituted tobacco sheet, and the supplying of the flavoring solution may include spraying the flavoring solution onto the initial reconstituted tobacco sheet passing through the periphery of the flavoring nozzle.

The flavoring apparatus may include a flavoring roller located above or under the initial reconstituted tobacco sheet, and the supplying of the flavoring solution may include applying the flavoring solution onto the initial reconstituted tobacco sheet passing through the periphery of the flavoring roller.

The flavoring apparatus may include a flavoring nozzle located above the initial reconstituted tobacco sheet and a flavoring roller located under the initial reconstituted tobacco sheet, and the supplying of the flavoring solution may include spraying the flavoring solution onto the initial reconstituted tobacco sheet passing through a lower portion of the flavoring nozzle and applying the flavoring solution onto the initial reconstituted tobacco sheet passing through an upper portion of the flavoring roller.

The flavoring apparatus may be provided as a plurality of flavoring apparatuses, and the supplying of the flavoring solution may include arranging the plurality of flavoring apparatuses in parallel with one another in a direction in which the initial reconstituted tobacco sheet is supplied, wherein each of the plurality of flavoring apparatuses supplies different flavoring solutions onto the initial reconstituted tobacco sheet.

The flavoring apparatus may be provided as a plurality of flavoring apparatuses, and the supplying of the flavoring solution may include arranging the plurality of flavoring apparatuses in parallel with one another in a direction perpendicular to the direction in which the initial reconstituted tobacco sheet is supplied, and supplying a flavoring solution onto the initial reconstituted tobacco sheet using the plurality of flavoring apparatuses.

The initial reconstituted tobacco sheet may be primary flavored (casing), and the supplying of the flavoring solution may include supplying the flavoring solution for secondary flavoring (top flavoring) onto the initial reconstituted tobacco sheet using the flavoring apparatus.

The manufacturing of the plurality of reconstituted tobacco strands may include: determining whether there is any defect in each of the plurality of secondary cutter; and when it is determined that some of the plurality of secondary cutters have a defect, detouring the plurality of intermediate reconstituted tobacco sheets using a bypass conveyor unit so that some of the plurality of intermediate reconstituted tobacco sheets are prevented from being fed into the secondary cutters which have a defect.

The method may further include: measuring a moisture content of the initial reconstituted tobacco sheet; and supplying moisture onto the initial reconstituted tobacco sheet using a water supply nozzle based on the measured moisture content.

The method may further include: measuring a moisture content of the initial reconstituted tobacco sheet; and drying the initial reconstituted tobacco sheet using a dryer based on the measured moisture content.

According to a second aspect of the present disclosure, an apparatus for manufacturing cut reconstituted tobacco, includes: a feed roller configured to supply an initial reconstituted tobacco sheet to a conveyor unit; a flavoring apparatus configured to supply a flavoring solution onto the initial reconstituted tobacco sheet; a primary cutter configured to manufacture a plurality of intermediate reconstituted tobacco sheets by cutting the initial reconstituted tobacco sheet; a plurality of secondary cutters arranged downstream of the primary cutter, configured to manufacture a plurality of reconstituted tobacco strands by cutting the plurality of intermediate reconstituted tobacco sheets in a longitudinal direction and spaced apart from one another by a certain distance; and a plurality of tertiary cutters arranged downstream of each of the plurality of secondary cutters and configured to manufacture a plurality of pieces of cut reconstituted tobaccos by cutting the plurality of reconstituted tobacco strands in a transverse direction.

According to a third aspect of the present disclosure, a method of manufacturing cut reconstituted tobacco, includes: supplying different types of initial reconstituted tobacco sheets in a plurality of parallel processes in which cut reconstituted tobacco is manufactured; manufacturing a plurality of intermediate reconstituted tobacco sheets by cutting the initial reconstituted tobacco sheet using a primary cutter in each of the plurality of parallel processes; manufacturing a plurality of reconstituted tobacco strands by cutting the plurality of intermediate reconstituted tobacco sheets in a longitudinal direction using a plurality of secondary cutters arranged downstream of the primary cutter and spaced apart from one another by a certain distance in each of the plurality of parallel processes; manufacturing a plurality of pieces of cut reconstituted tobaccos by cutting the plurality of reconstituted tobacco strands in a transverse direction using a plurality of tertiary cutters arranged downstream of each of the plurality of secondary cutters in each of the plurality of parallel processes; and manufacturing mixed cut reconstituted tobacco by mixing a plurality of different types of cut reconstituted tobacco manufactured in the parallel processes.

According to a fourth aspect of the present disclosure, an apparatus for manufacturing cut reconstituted tobacco, includes: a plurality of feed rollers configured to supply different types of initial reconstituted tobacco sheets to a conveyor unit for parallel processes in which cut reconstituted tobacco is manufactured; a primary cutter configured to manufacture a plurality of intermediate reconstituted tobacco sheets by cutting the initial reconstituted tobacco sheet in each of the parallel processes; a plurality of secondary cutters configured to manufacture a plurality of reconstituted tobacco strands by cutting the plurality of intermediate reconstituted tobacco sheets in a longitudinal direction in each of the parallel processes, wherein the plurality of secondary cutters are arranged downstream of the primary cutter and spaced apart from one another by a certain distance; a plurality of tertiary cutters configured to manufacture a plurality of pieces of cut reconstituted tobaccos by cutting the plurality of reconstituted tobacco strands in a transverse direction in each of the parallel processes, wherein the plurality of tertiary cutters are arranged downstream of each of the plurality of secondary cutters; and a mixer configured to manufacture mixed cut reconstituted tobacco by mixing a plurality of different types of cut reconstituted tobacco manufactured in the parallel processes.

MODE OF DISCLOSURE

With respect to the terms used to describe the various exemplary embodiments, general terms which are currently and widely used are selected in consideration of functions of structural elements in the various exemplary embodiments of the present disclosure. However, meanings of the terms can be changed according to intention, a judicial precedence, the appearance of new technology, and the like. Also, in a special case, there may be terms that are arbitrarily selected by the applicant. In this case, the meanings of the terms will be described in detail in the description of the present disclosure. Thus, the terms used herein will be defined based on not simply the names of the terms but the meanings thereof and contents of the present disclosure.

In addition, unless explicitly described to the contrary, the word "comprise" and variations such as "comprises" or "comprising" will be understood to imply the inclusion of stated elements but not the exclusion of any other elements. Also, the terms such as "~~ unit", "~~ module", and the like, used herein refer to a unit for performing at least one function or operation, and the unit or module may be implemented with hardware or software or a combination of hardware and software. It will be understood that when an element or layer is referred to as being "over." "above." "on," "connected to" or "coupled to" another element or layer, it can be directly over, above, on, connected or coupled to the other element or layer or intervening elements or layers may be present. In contrast, when an element is referred to as being "directly over." "directly above," "directly on," "directly connected to" or "directly coupled to" another element or layer, there are no intervening elements or layers present. Like numerals refer to like elements throughout.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the exemplary embodiments set forth herein.

In the following exemplary embodiments, the terms "upstream" and "downstream" are the terms used to indicate relative positions of a plurality of cutters included in an apparatus for manufacturing cut reconstituted tobacco. The term "upstream" indicates a direction in which reconstituted sheets are supplied to the apparatus for manufacturing cut reconstituted tobacco, and the term "downstream" indicates a direction in which cut reconstituted tobacco manufactured by the apparatus for manufacturing cut reconstituted tobacco is dispensed. Also, the term "longitudinal direction" indicates a direction in which a conveyor unit of the apparatus for manufacturing reconstituted tobacco moves, and the term "transverse direction" indicates a direction perpendicular to the direction in which the conveyor unit moves.

Hereinafter, exemplary embodiments of the present disclosure will be described in detail with reference to the accompanying drawings.

Figure 2:
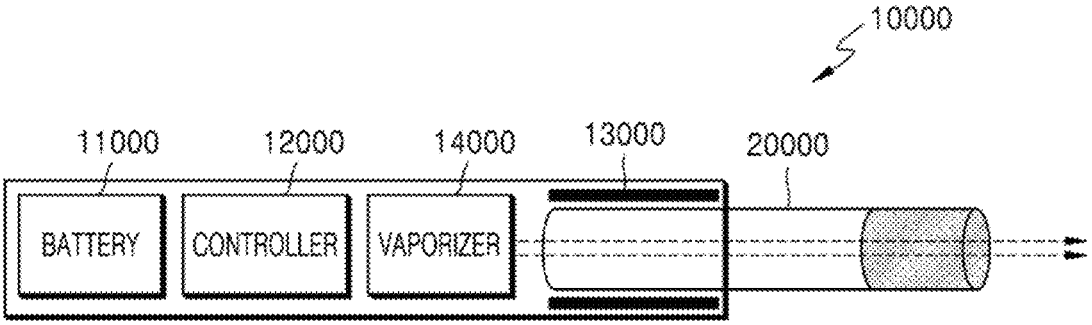
Figure 3:
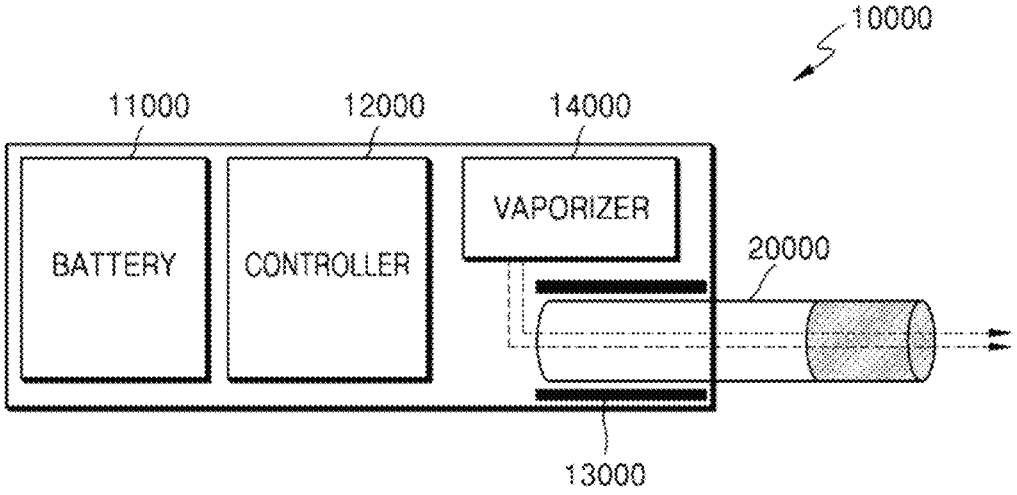

FIGS. 1 through 3 are diagrams showing examples in which a cigarette is inserted into an aerosol generating device.

Referring to FIG. 1, the aerosol generating device 10000 may include a battery 11000, a controller 12000, and a heater 13000. Referring to FIGS. 2 and 3, the aerosol generating device 10000 may further include a vaporizer 14000. Also, the cigarette 20000 may be inserted into an inner space of the aerosol generating device 10000.

FIGS. 1 through 3 illustrate components of the aerosol generating device 10000, which are related to the present exemplary embodiment. Therefore, it will be understood by one of ordinary skill in the art related to the present exemplary embodiment that other general-purpose components may be further included in the aerosol generating device 10000, in addition to the components illustrated in FIGS. 1 through 3.

Also, FIGS. 2 and 3 illustrate that the aerosol generating device 10000 includes the heater 13000. However, according to necessity, the heater 13000 may be omitted.

FIG. 1 illustrates that the battery 11000, the controller 12000, and the heater 13000 are arranged in series. Also, FIG. 2 illustrates that the battery 11000, the controller 12000, the vaporizer 14000, and the heater 13000 are arranged in series. Also, FIG. 3 illustrates that the vaporizer 14000 and the heater 13000 are arranged in parallel. However, the internal structure of the aerosol generating device 10000 is not limited to the structures illustrated in FIGS. 1 through 3. In other words, according to the design of the aerosol generating device 10000, the battery 11000, the controller 12000, the heater 13000, and the vaporizer 14000 may be differently arranged.

When the cigarette 20000 is inserted into the aerosol generating device 10000, the aerosol generating device 10000 may operate the heater 13000 and/or the vaporizer 14000 to generate aerosol from the cigarette 20000 and/or the vaporizer 14000. The aerosol generated by the heater 13000 and/or the vaporizer 14000 is delivered to a user by passing through the cigarette 20000.

According to necessity, even when the cigarette 20000 is not inserted into the aerosol generating device 10000, the aerosol generating device 10000 may heat the heater 13000.

The battery 11000 may supply power to be used for the aerosol generating device 10000 to operate. For example, the battery 11000 may supply power to heat the heater 13000 or the vaporizer 14000, and may supply power for operating the controller 12000. Also, the battery 11000 may supply power for operations of a display, a sensor, a motor, etc. mounted in the aerosol generating device 10000.

The controller 12000 may generally control operations of the aerosol generating device 10000. In detail, the controller 12000 may control not only operations of the battery 11000, the heater 13000, and the vaporizer 14000, but also operations of other components included in the aerosol generating device 10000. Also, the controller 12000 may check a state of each of the components of the aerosol generating device 10000 to determine whether or not the aerosol generating device 10000 is able to operate.

The controller 12000 may include at least one processor. A processor can be implemented as an array of a plurality of logic gates or can be implemented as a combination of a microprocessor and a memory in which a program executable in the microprocessor is stored. It will be understood by one of ordinary skill in the art that the processor can be implemented in other forms of hardware.

The heater 13000 may be heated by the power supplied from the battery 11000. For example, when the cigarette 20000 is inserted into the aerosol generating device 10000, the heater 13000 may be located outside the cigarette 20000. Thus, the heated heater 13000 may increase a temperature of an aerosol generating material in the cigarette 20000.

The heater 13000 may include an electro-resistive heater. For example, the heater 13000 may include an electrically conductive track, and the heater 13000 may be heated when currents flow through the electrically conductive track. However, the heater 13000 is not limited to the example described above and may include all heaters which may be heated to a desired temperature. Here, the desired temperature may be pre-set in the aerosol generating device 10000 or may be set as a temperature desired by a user.

As another example, the heater 13000 may include an induction heater. In detail, the heater 13000 may include an electrically conductive coil for heating a cigarette in an induction heating method, and the cigarette may include a susceptor which may be heated by the induction heater.

For example, the heater 13000 may include a tube-type heating element, a plate-type heating element, a needle-type heating element, or a rod-type heating element, and may heat the inside or the outside of the cigarette 20000, according to the shape of the heating element.

Also, the aerosol generating device 10000 may include a plurality of heaters 13000. Here, the plurality of heaters 13000 may be inserted into the cigarette 20000 or may be arranged outside the cigarette 20000. Also, some of the plurality of heaters 13000 may be inserted into the cigarette 20000 and the others may be arranged outside the cigarette 20000. In addition, the shape of the heater 13000 is not limited to the shapes illustrated in FIGS. 1 through 3 and may include various shapes.

The vaporizer 14000 may generate aerosol by heating a liquid composition and the generated aerosol may pass through the cigarette 20000 to be delivered to a user. In other words, the aerosol generated via the vaporizer 14000 may move along an air flow passage of the aerosol generating device 10000 and the air flow passage may be configured such that the aerosol generated via the vaporizer 14000 passes through the cigarette 20000 to be delivered to the user.

For example, the vaporizer 14000 may include a liquid storage, a liquid delivery element, and a heating element, but it is not limited thereto. For example, the liquid storage, the liquid delivery element, and the heating element may be included in the aerosol generating device 10000 as independent modules.

The liquid storage may store a liquid composition. For example, the liquid composition may be a liquid including a tobacco-containing material having a volatile tobacco flavor component, or a liquid including a non-tobacco material. The liquid storage may be formed to be detachable from the vaporizer 14000 or may be formed integrally with the vaporizer 14000.

For example, the liquid composition may include water, a solvent, ethanol, plant extract, spices, flavorings, or a vitamin mixture. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. Also, the liquid composition may include an aerosol forming substance, such as glycerin and propylene glycol.

The liquid delivery element may deliver the liquid composition of the liquid storage to the heating element. For example, the liquid delivery element may be a wick such as cotton fiber, ceramic fiber, glass fiber, or porous ceramic, but is not limited thereto.

The heating element is an element for heating the liquid composition delivered by the liquid delivery element. For example, the heating element may be a metal heating wire, a metal hot plate, a ceramic heater, or the like, but is not limited thereto. In addition, the heating element may include a conductive filament such as nichrome wire and may be positioned as being wound around the liquid delivery element. The heating element may be heated by a current supply and may transfer heat to the liquid composition in contact with the heating element, thereby heating the liquid composition. As a result, aerosol may be generated.

For example, the vaporizer 14000 may be referred to as a cartomizer or an atomizer, but it is not limited thereto.

The aerosol generating device 10000 may further include general-purpose components in addition to the battery 11000, the controller 12000, the heater 13000, and the vaporizer 14000. For example, the aerosol generating device 10000 may include a display capable of outputting visual information and/or a motor for outputting haptic information. Also, the aerosol generating device 10000 may include at least one sensor (a puff detecting sensor, a temperature detecting sensor, a cigarette insertion detecting sensor, etc.). Also, the aerosol generating device 10000 may be formed as a structure where, even when the cigarette 20000 is inserted into the aerosol generating device 10000, external air may be introduced or internal air may be discharged.

Although not illustrated in FIGS. 1 through 3, the aerosol generating device 10000 and an additional cradle may form together a system. For example, the cradle may be used to charge the battery 11000 of the aerosol generating device 10000. Alternatively, the heater 13000 may be heated when the cradle and the aerosol generating device 10000 are coupled to each other.

The cigarette 20000 may be similar to a general combustive cigarette. For example, the cigarette 20000 may be divided into a first portion including an aerosol generating material and a second portion including a filter, etc. Alternatively, the second portion of the cigarette 20000 may also include an aerosol generating material. For example, an aerosol generating material made in the form of granules or capsules may be inserted into the second portion.

The entire first portion may be inserted into the aerosol generating device 10000, and the second portion may be exposed to the outside. Alternatively, only a portion of the first portion may be inserted into the aerosol generating device 10000. Otherwise, the entire first portion and a portion of the second portion may be inserted into the aerosol generating device 10000. The user may puff aerosol while holding the second portion by the mouth of the user. In this case, the aerosol is generated by the external air passing through the first portion, and the generated aerosol passes through the second portion and is delivered to the user's mouth.

For example, the external air may flow into at least one air passage formed in the aerosol generating device 10000. For example, opening and closing of the air passage and/or a size of the air passage may be adjusted by the user. Accordingly, the amount of smoke and smoking satirsfaction may be adjusted by the user. As another example, the external air may flow into the cigarette 20000 through at least one hole formed in a surface of the cigarette 20000.

Hereinafter, an example of the cigarette 20000 will be described with reference to FIG. 4.

Figure 4:
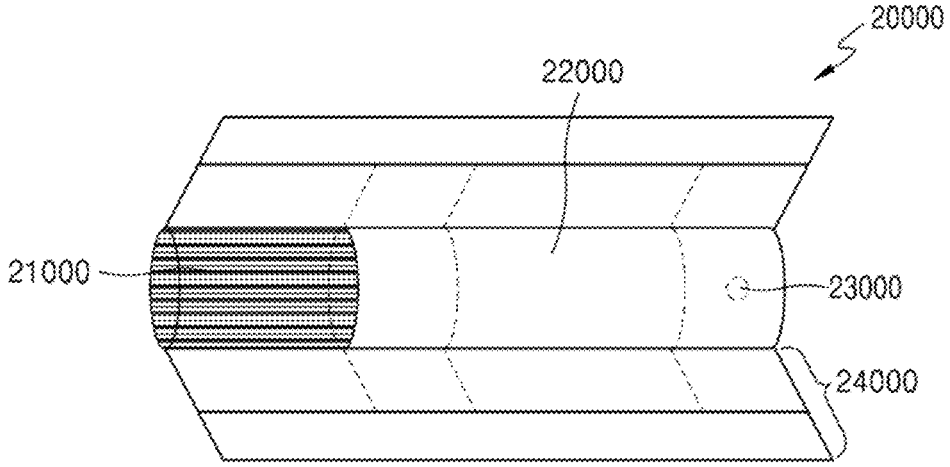
FIG. 4 illustrates an example of a cigarette.

FIG. 4 illustrates an example of a cigarette.

Referring to FIG. 4, the cigarette 20000 may include a tobacco rod 21000 and a filter rod 22000. The first portion 21000 described above with reference to FIGS. 1 through 3 may include the tobacco rod, and the second portion may include the filter rod 22000.

FIG. 4 illustrates that the filter rod 22000 includes a single segment. However, the filter rod 22000 is not limited thereto. In other words, the filter rod 22000 may include a plurality of segments. For example, the filter rod 22000 may include a first segment configured to cool an aerosol and a second segment configured to filter a certain component included in the aerosol. Also, as necessary, the filter rod 22000 may further include at least one segment configured to perform other functions.

The cigarette 2000 may be packaged using at least one wrapper 24000. The wrapper 24000 may have at least one hole through which external air may be introduced or internal air may be discharged. For example, the cigarette 20000 may be packaged using one wrapper 24000. As another example, the cigarette 20000 may be doubly packaged using at least two wrappers 24000. For example, the tobacco rod 21000 may be packaged using a first wrapper, and the filter rod 22000 may be packaged using a second wrapper. Also, the tobacco rod 21000 and the filter rod 22000, which are respectively packaged using separate wrappers, may be coupled to each other, and the entire cigarette 20000 may be packaged using a third wrapper. When each of the tobacco rod 21000 and the filter rod 22000 includes a plurality of segments, each segment may be packaged using a separate wrapper. Also, the entire cigarette 20000 including the plurality of segments, which are respectively packaged using the separate wrappers may be combined and re-packaged together using another wrapper.

The tobacco rod 21000 may include an aerosol generating material. For example, the aerosol generating material may include at least one of glycerin, propylene glycol, ethylene glycol, dipropylene glycol, diethylene glycol, triethylene glycol, tetraethylene glycol, and oleyl alcohol, but it is not limited thereto. Also, the tobacco rod 21000 may include other additives, such as flavors, a wetting agent, and/or organic acid. Also, the tobacco rod 21000 may include a flavored liquid, such as menthol or a moisturizer, which is injected to the tobacco rod 21000.

The tobacco rod 21000 may be manufactured in various forms. For example, the tobacco rod 21000 may be formed as a sheet or a strand. Also, the tobacco rod 21000 may be formed as a pipe tobacco, which is formed of tiny bits cut from a tobacco sheet. Also, the tobacco rod 21000 may be surrounded by a heat conductive material. For example, the heat-conducting material may be, but is not limited to, a metal foil such as aluminum foil. For example, the heat conductive material surrounding the tobacco rod 21000 may uniformly distribute heat transmitted to the tobacco rod 21000, and thus, the heat conductivity applied to the tobacco rod may be increased and taste of the tobacco may be improved. Also, the heat conductive material surrounding the tobacco rod 21000 may function as a susceptor heated by the induction heater. Here, although not illustrated in the drawings, the tobacco rod 21000 may further include an additional susceptor, in addition to the heat conductive material surrounding the tobacco rod 21000.

The filter rod 22000 may include a cellulose acetate filter. Shapes of the filter rod 22000 are not limited. For example, the filter rod 22000 may include a cylinder-type rod or a tube-type rod having a hollow inside. Also, the filter rod 22000 may include a recess-type rod. When the filter rod 22000 includes a plurality of segments, at least one of the plurality of segments may have a different shape.

The filter rod 22000 may be formed to generate flavors. For example, a flavoring liquid may be injected onto the filter rod 22000, or an additional fiber coated with a flavoring liquid may be inserted into the filter rod 22000.

Also, the filter rod 22000 may include at least one capsule 23000. Here, the capsule 23000 may generate a flavor or aerosol. For example, the capsule 23000 may have a configuration in which a liquid containing a flavoring material is wrapped with a film. For example, the capsule 23000 may have a spherical or cylindrical shape, but is not limited thereto.

When the filter rod 22000 includes a segment configured to cool the aerosol, the cooling segment may include a polymer material or a biodegradable polymer material. For example, the cooling segment may include pure polylactic acid alone, but the material for forming the cooling segment is not limited thereto. In some exemplary embodiments, the cooling segment may include a cellulose acetate filter having a plurality of holes. However, the cooling segment is not limited to the above-described example and any other cooling segment that is capable of cooling the aerosol may be used.

Although not illustrated in FIG. 4, the cigarette 20000 according to an exemplary embodiment may further include a front-end filter. The front-end filter may be located on a side of the tobacco rod 21000, which is the side not facing the filter rod 22000. The front-end filter may prevent the tobacco rod 21000 from being detached outwards and prevent a liquefied aerosol from flowing into the aerosol generating device 10000 (FIGS. 1 through 3) from the tobacco rod 21000, during smoking.

Figure 5:
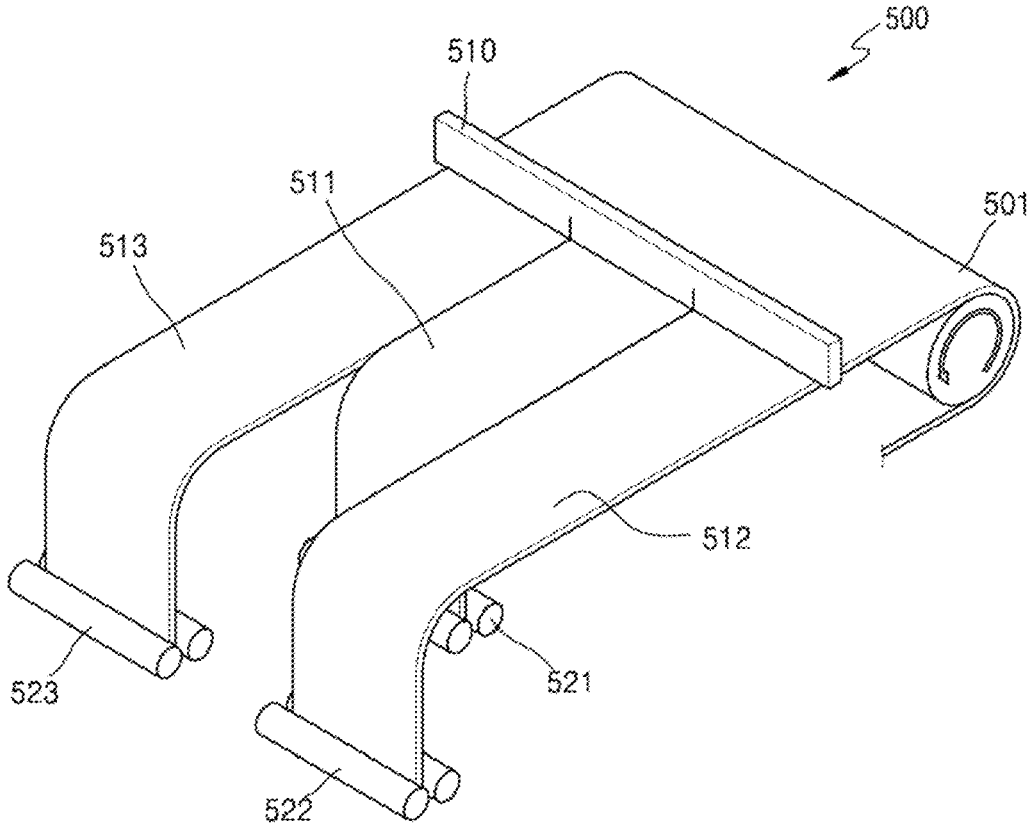
FIG. 5 is a diagram showing an apparatus for manufacturing reconstituted tobacco, wherein the apparatus includes a primary cutter and a secondary cutter, according to an exemplary embodiment.

FIG. 5 is a diagram showing an apparatus for manufacturing reconstituted tobacco, which includes a primary cutter and a secondary cutter, according to an exemplary embodiment.

Referring to FIG. 5, an apparatus 500 for manufacturing cut reconstituted tobacco may supply an initial reconstituted tobacco sheet 501 to a conveyor unit in a manufacturing process of the cut reconstituted tobacco.

The initial reconstituted tobacco sheet 501 may be formed by agglomerating particulate tobacco obtained by grinding or pulverizing one or both of a leaf lamina and a tobacco leaf stem. Also, the initial reconstituted tobacco sheet 501 may include one or more traces of tobacco powder, tobacco fines, and other particulate tobacco by-products formed during the processing, handling, and delivery of tobacco.

The initial reconstituted tobacco sheet 501 may include one or more endogenous binders, one or more exogenous binders, or a combination thereof to promote aggregating of the tobacco particles.

Also, the initial reconstituted tobacco sheet 501 may include other additives such as tobacco fibers, non-tobacco fibers, aerosol formers, wetting agents, plasticizers, flavoring solutions, fillers, aqueous and non-aqueous solvents, and combinations thereof. The other additives are not limited thereto.

When the initial reconstituted tobacco sheet 501 is used as an aerosol-forming substrate of a heated aerosol generating article, the initial reconstituted tobacco sheet 501 may have an aerosol former content greater than about 5% by dry weight. The initial reconstituted tobacco sheet 501 used for the heated aerosol generating article may have an aerosol former content between about 5% and about 30% by dry weight.

On the other hand, the initial reconstituted tobacco sheet 501 may be manufactured through the following process. Tobacco raw material is first pulverized using a hammer mill, and the first-pulverized tobacco raw material is shifted to perform primary size separation. Further, the tobacco raw material is secondarily pulverized using a cutter mill, and secondary size separation is performed on the secondarily-pulverized tobacco raw material using a vibrating screen. Subsequently, the additive is mixed with the pulverized tobacco raw material, and after a process of refining and stirring, a slurry is produced. The slurry is thinned to produce the sheet, which is dried to produce the initial reconstituted tobacco sheet 501. However, a manufacturing process of the initial reconstituted tobacco sheet 50 is not limited thereto.

In an exemplary embodiment, the apparatus 500 for manufacturing the cut reconstituted tobacco may supply the initial reconstituted tobacco sheet 501 to the conveyor unit using a feed roller. The conveyor unit may be a conveyor belt but is not limited thereto.

The apparatus 500 for manufacturing cut reconstituted tobacco may include a primary conveyor unit that injects the initial reconstituted tobacco sheet 501 into the primary cutter 510, and a secondary conveyor unit that injects each of a plurality of intermediate reconstituted tobacco sheets 511 through 513 into each of a plurality of secondary cutters 521 through 523. The number of secondary conveyor units may be determined based on the number of the plurality of intermediate reconstituted tobacco sheets 511 through 513. For example, when three intermediate reconstituted tobacco sheets 511 through 513 are manufactured via the primary cutter 510, as shown in FIG. 5, three secondary conveyor units may be included in the apparatus 500 for manufacturing cut reconstituted tobacco.

The initial reconstituted tobacco sheet 501 injected into the primary cutter 510 may be cut into a predetermined number of intermediate reconstituted tobacco sheets 511 through 513. In an exemplary embodiment, cutting edges may be arranged at the bottom of the primary cutter 510. Furthermore, in another exemplary embodiment, the primary cutter 510 may include two rollers that face each other. The two rollers may be rotated in opposite directions so that the initial reconstituted tobacco sheet 501 injected into the primary cutter 510 may pass through the primary cutter 510. A plurality of cutting edges may be arranged on an outer circumferential surface of each of the two rollers. That is, the initial reconstituted tobacco sheet 501 may be cut by the plurality of cutting edges while passing through the primary cutter 510, so the plurality of intermediate reconstituted tobacco sheets 511 through 513 may be manufactured.

For example, in the apparatus 500 for manufacturing cut reconstituted tobacco, three intermediate reconstituted tobacco sheets 511 through 513 may be manufactured by cutting the initial reconstituted tobacco sheet 501 using the primary cutter 510. However, the number of intermediate reconstituted tobacco sheets 511 through 513 is not limited thereto.

The apparatus 500 for manufacturing cut reconstituted tobacco may inject each of the intermediate reconstituted tobacco sheets 511 through 513 into the secondary cutters 521 through 523 using the secondary conveyor unit. The secondary cutters 521 through 523 may be arranged downstream of the primary cutter 510. Furthermore, the secondary cutters 521 through 523 may be spaced apart from one another by a certain distance.

In an exemplary embodiment, the secondary cutters 521 through 523 may be arranged in parallel with respect to the primary cutter 510, in a stepped manner, or in a zigzag manner. However, the arrangements of the secondary cutters 521 through 523 are not limited thereto.

In the apparatus 500 for manufacturing cut reconstituted tobacco, the intermediate reconstituted tobacco sheets 511 through 513 are cut in a longitudinal direction using the secondary cutters 521 through 523 so that a plurality of reconstituted tobacco strands may be manufactured in each of the intermediate reconstituted tobacco sheets 511 through 513.

Each of the intermediate reconstituted tobacco sheets 511 through 513 may be processed into a plurality of reconstituted tobacco strands based on the cutting specifications set in the secondary cutters 521 through 523. In an exemplary embodiment, the cutting specifications of the secondary cutters 521 through 523 may set the number of reconstituted tobacco strands, but are not limited thereto.

On the other hand, the rotational force of the feed roller for supplying the initial reconstituted tobacco sheet 501 to the conveyor unit may be different for each portion of the feed roller. For example, the rotational force of the feed roller may become weaker from the middle toward the edge of the feed roller. Thus, if the initial reconstituted tobacco sheet 501 supplied through the feed roller is directly cut in the longitudinal direction without being cut into a plurality of intermediate reconstituted tobacco sheets 511 through 513, there may be a difference in quality of reconstituted tobacco strands manufactured between the ones supplied by the middle portion and the ones supplied by the edge portion of the feed roller. This may result in a difference in the quality of cut reconstituted tobacco manufactured by cutting the reconstituted tobacco strands.

In the apparatus 500 for manufacturing cut reconstituted tobacco according to the present exemplary embodiment, in order for the reconstituted tobacco strands manufactured from the reconstituted tobacco sheet supplied via the feed roller to have uniform quality, instead of directly cutting the initial reconstituted tobacco sheet 510 in the longitudinal direction, first, the initial reconstituted tobacco sheet 501 is cut into a plurality of intermediate reconstituted tobacco sheets 511 through 513 having smaller widths using the primary cutter 510 and then each of the intermediate reconstituted tobacco sheets 511 through 513 is cut in the longitudinal direction using the secondary cutters 521 through 523, so that a plurality of reconstituted tobacco strands may be manufactured.

Also, the apparatus 500 for manufacturing cut reconstituted tobacco may further include a defect detection device that may determine whether there is any defect in each of the secondary cutters 521 through 523. In an exemplary embodiment, the defect detection device may detect a defect such as presence of foreign substances in the secondary cutters 521 through 523, or broken cutting edges. When it is determined by the defect detection device that some of the secondary cutters 521 through 523 have a defect, the apparatus 500 for manufacturing cut reconstituted tobacco may prevent the intermediate reconstituted tobacco sheet from being fed into the secondary cutters which have a defect.

In an exemplary embodiment, the apparatus 500 for manufacturing cut reconstituted tobacco may stop the operation of the secondary conveyor unit for moving the intermediate reconstituted tobacco sheet to the secondary cutters which have a defect. Alternatively, the apparatus 500 for manufacturing cut reconstituted tobacco may further include a bypass conveyor unit. The bypass conveyor unit may detour the intermediate reconstituted tobacco sheet that is fed into the secondary cutters which have a defect. The apparatus 500 for manufacturing cut reconstituted tobacco may be configured to arrange a roller at an end of the bypass conveyor unit so as to collect the intermediate reconstituted tobacco sheet in a roll form. The intermediate reconstituted tobacco sheet collected in the roll form may be cut by secondary cutters which have no defect, or restored secondary cutters.

The apparatus 500 for manufacturing cut reconstituted tobacco according to the present exemplary embodiment uses the plurality of secondary cutters 521 through 523. Thus, even when some of the secondary cutters 521 through 523 have a defect, a process may be performed using the remaining secondary cutters without stopping the process.

In an exemplary embodiment, some of the conveyor units may be arranged horizontally with respect to the ground, and the remaining conveyor units may be arranged obliquely with respect to the ground. For example, the initial reconstituted tobacco sheet 501 may move horizontally, pass through the primary cutter 510, and be cut into the intermediate reconstituted tobacco sheets 511 through 513. The intermediate reconstituted tobacco sheets 511 through 513 may move a certain distance horizontally, move obliquely, and then be injected into the secondary cutters 521 through 523. However, an example of arrangement of the conveyor units is not limited thereto.

The apparatus 500 for manufacturing cut reconstituted tobacco may include a plurality of tertiary cutters arranged downstream of each of the plurality of secondary cutters 521 through 523. The tertiary cutters may be spaced apart from the secondary cutters 521 through 523 by a certain distance. The apparatus 500 for manufacturing cut reconstituted tobacco may cut the plurality of reconstituted tobacco strands in the transverse direction using the tertiary cutters, thereby manufacturing a plurality of pieces of cut reconstituted tobaccos. The tertiary cutters will be described below with reference to FIG. 7.

Figure 6:
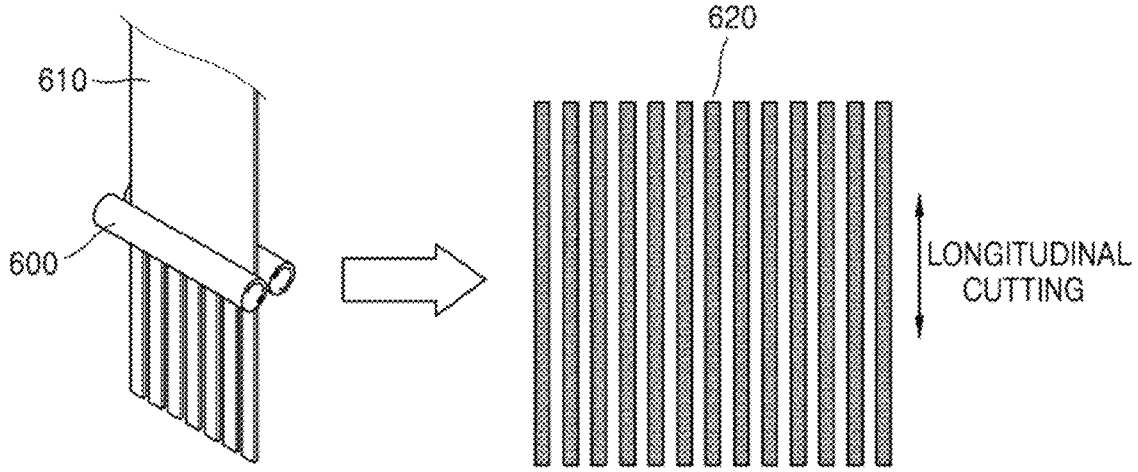
FIG. 6 is a diagram showing an example in which reconstituted tobacco strands are manufactured using the secondary cutter according to an exemplary embodiment.

FIG. 6 is a diagram showing an example in which reconstituted tobacco strands are manufactured using the secondary cutter according to an exemplary embodiment.

Referring to FIG. 6, an apparatus for manufacturing cut reconstituted tobacco may inject an intermediate reconstituted tobacco sheet 610 into a secondary cutter 600 using a conveyor unit. In an exemplary embodiment, the conveyor unit that moves the intermediate reconstituted tobacco sheet 610 to the secondary cutter 600 may be arranged obliquely (or vertically) with respect to the ground.

The apparatus for manufacturing cut reconstituted tobacco may cut the intermediate reconstituted tobacco sheet 610 in the longitudinal direction using the secondary cutter 600, thereby manufacturing a plurality of reconstituted tobacco strands 620. The term "longitudinal direction" may refer to a moving direction of the intermediate reconstituted tobacco sheet 610 in the manufacturing process.

In an exemplary embodiment, the secondary cutter 600 may include two rollers that face each other. The two rollers may be rotated in opposite directions so that the intermediate reconstituted tobacco sheet 610 injected into the secondary cutter 600 may pass through the secondary cutter 600. In addition, a plurality of cutting edges may be arranged on an outer circumferential surface of each of the rollers. That is, the intermediate reconstituted tobacco sheet 610 may be cut by the plurality of cutting edges while passing through the secondary cutter 600, and thus the plurality of reconstituted tobacco strands 620 may be manufactured.

Each intermediate reconstituted tobacco sheet 610 may be processed into the plurality of reconstituted tobacco strands 620 according to the cutting specifications set in the secondary cutter 600. In an exemplary embodiment, the number of reconstituted tobacco strands 620 to be manufactured may be determined according to the number of cutting edges arranged on the outer circumferential surface of each of the rollers included in the secondary cutter 600.

Figure 7:
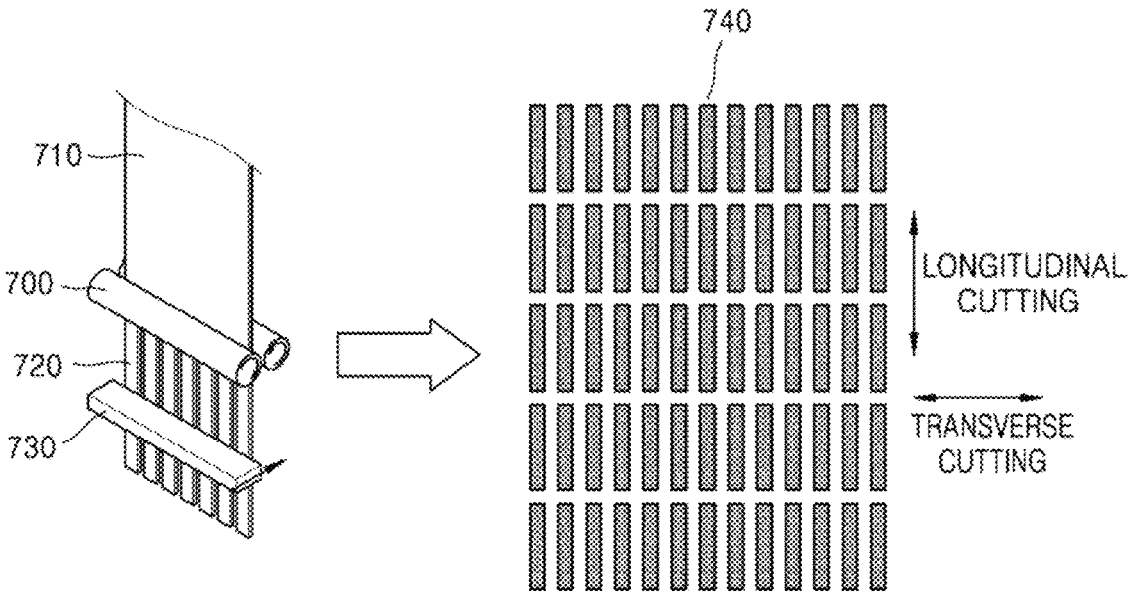
FIG. 7 is a diagram showing an example in which cut reconstituted tobacco is manufactured using a tertiary cutter according to an exemplary embodiment.

FIG. 7 is a diagram showing an example in which cut reconstituted tobacco is manufactured using a tertiary cutter according to an exemplary embodiment.

Referring to FIG. 7, an apparatus for manufacturing the cut reconstituted tobacco may inject an intermediate reconstituted tobacco sheet 710 into a secondary cutter 700 using a conveyor unit. The apparatus for manufacturing the cut reconstituted tobacco may cut the intermediate reconstituted tobacco sheet 710 in the longitudinal direction using the secondary cutter 700, thereby manufacturing a plurality of reconstituted tobacco strands 720.

Details of the secondary cutter 700 are provided above with reference to FIG. 6.

A tertiary cutter 730 may be positioned downstream of the secondary cutter 700. The tertiary cutter 730 may be spaced apart from the secondary cutter 700 by a certain distance. The apparatus for manufacturing cut reconstituted tobacco may cut the plurality of reconstituted tobacco strands 720 in the transverse direction using the tertiary cutter 730, thereby manufacturing a plurality of pieces of cut reconstituted tobaccos 740. The term "transverse direction" may refer to a direction perpendicular to the moving direction of the intermediate reconstituted tobacco sheet 710.

In an exemplary embodiment, the tertiary cutter 730 may be cutting scissors. The cutting scissors may include a first blade including a first cutting surface and a second blade including a second cutting surface, wherein the second cutting surface intersects the first cutting surface to cut an object. The first blade and the second blade of the tertiary cutter 730 may be perpendicular to the moving direction of the intermediate reconstituted tobacco sheet 710. The plurality of reconstituted tobacco strands 720 passing through the secondary cutter 700 may be cut by the first cutting surface of the first blade and the second cutting surface of the second blade of the tertiary cutter 730 so that a plurality of pieces of cut reconstituted tobaccos 740 may be manufactured.

The plurality of reconstituted tobacco strands 720 may be processed into the plurality of pieces of cut reconstituted tobacco 740 based on the cut specifications set in the tertiary cutter 730. In an exemplary embodiment, the longitudinal length of the plurality of pieces of cut reconstituted tobacco 740 may be determined according to a blade crossing period of the tertiary cutter 730. Also, the longitudinal length of the plurality of pieces of cut reconstituted tobacco 740 may be determined according to a rotation speed of the secondary cutter 700 in addition to the blade crossing period.

Figure 8:
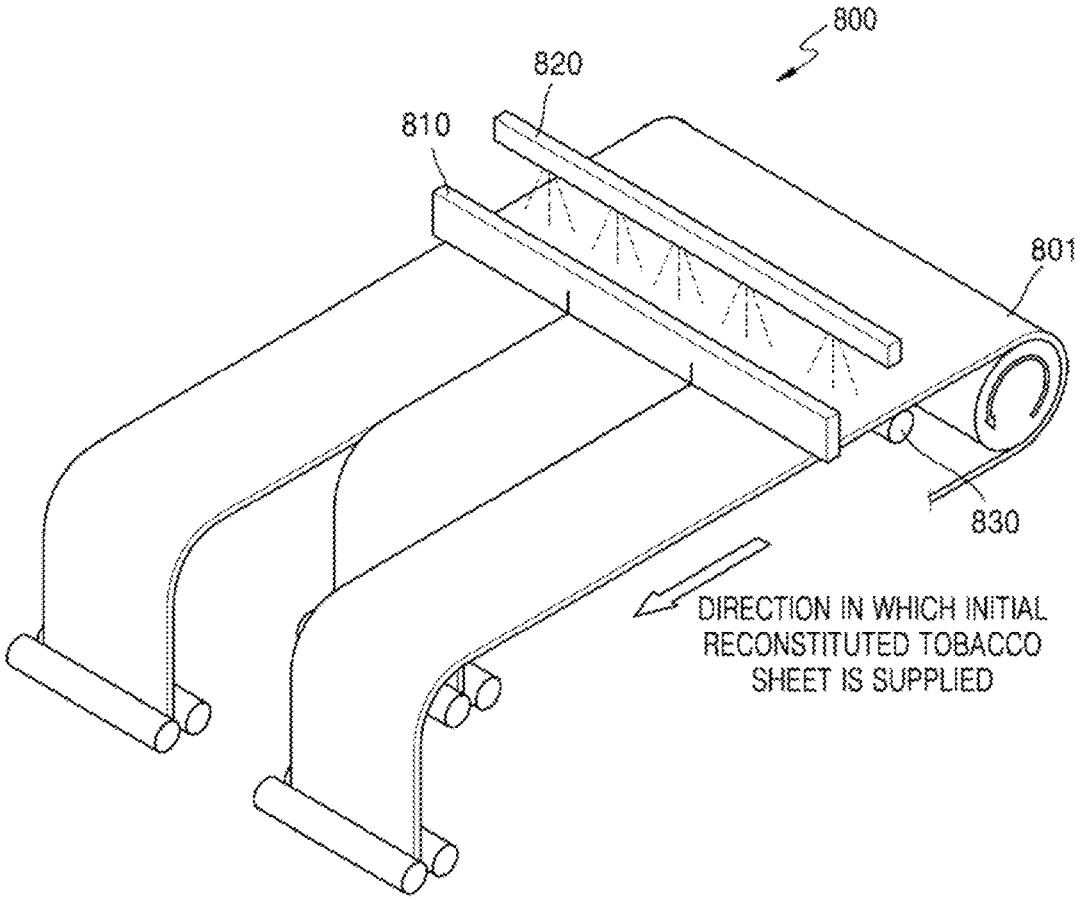
FIG. 8 is a diagram showing an apparatus for manufacturing reconstituted tobacco, wherein the apparatus includes a flavoring apparatus, according to an exemplary embodiment.

FIG. 8 is a diagram showing an apparatus for manufacturing reconstituted tobacco, which includes a flavoring apparatus, according to an exemplary embodiment.

An apparatus 800 for manufacturing cut reconstituted tobacco of FIG. 8 may include a feed roller, a primary cutter, a secondary cutter, and a tertiary cutter. Details of the feed roller, the primary cutter, the secondary cutter, and the tertiary cutter are provided above with reference to FIGS. 5 through 7.

Referring to FIG. 8, the apparatus 800 for manufacturing cut reconstituted tobacco may be configured to supply an initial reconstituted tobacco sheet 801 to a conveyor unit for a manufacturing process of the cut reconstituted tobacco. The apparatus 800 for manufacturing cut reconstituted tobacco may supply a flavoring solution onto the initial reconstituted tobacco sheet 801 using a flavoring apparatus 820 before the initial reconstituted tobacco sheet 801 is cut into a plurality of intermediate reconstituted tobacco sheets by a primary cutter 810.

The apparatus 800 for manufacturing cut reconstituted tobacco according to the present exemplary embodiment may be configured to supply a flavoring solution onto the initial reconstituted tobacco sheet 801 using the flavoring apparatus 820 before the initial reconstituted tobacco sheet 801 is cut into the plurality of intermediate reconstituted tobacco sheets by the primary cutter 810, such that the initial reconstituted tobacco sheet 801 may be uniformly flavored.

In an exemplary embodiment, the initial reconstituted tobacco sheet 801 may be a flavored sheet. A flavoring method may be classified into primary flavoring (casing) and secondary flavoring (top flavoring).

Primary flavoring (casing) is a process of softening smoke. A material for primary flavoring (casing) includes liquorice, corn syrup, sugar, and the like, but is not limited thereto. On the other hand, dipping tobacco into a casing mixture or spraying the casing mixture into the tobacco may be used as a method of performing primary flavoring (casing) on the tobacco.

Secondary flavoring (top flavoring) is a process of improving a cigarette's unique taste. A material for secondary flavoring (top flavoring) includes a variety of fruits, such as orange, grapes, and the like, coffee, menthol, etc., but is not limited thereto.

The material for primary flavoring (casing) is mostly water soluble, heavy, and heat resistant. On the other hand, the material for secondary flavoring (top flavoring) is mostly fat soluble and has high volatility and heat resistance.

Later in the manufacturing process of the initial reconstituted tobacco sheet 801, there is an operation of drying the initial reconstituted tobacco sheet 801. In general, in the drying operation, a sheet is dried for about 5 minutes at a temperature over 100° C. In this way, as the initial reconstituted tobacco sheet 801 is dried at a high temperature for a long time in the process of manufacturing the initial reconstituted tobacco sheet 801, even when the initial reconstituted tobacco sheet 801 before being dried is secondary flavored (top flavored), a substantial portion of the material for secondary flavoring (top flavoring) may be thermally deformed or lost during the drying operation.

The apparatus 800 for manufacturing cut reconstituted tobacco may receive the initial reconstituted tobacco sheet 801 that is primary-flavored (casing) from the feed roller. The apparatus 800 for manufacturing cut reconstituted tobacco may supply a flavoring solution for secondary flavoring (top flavoring) onto the initial reconstituted tobacco sheet 801 using the flavoring apparatus 820 located downstream of the feed roller.

The apparatus 800 for manufacturing cut reconstituted tobacco according to the present exemplary embodiment may receive the initial reconstituted tobacco sheet 801 that is only primary flavored (casing), instead of receiving the initial reconstituted tobacco sheet that is primary flavored (casing) and secondary flavored (top flavored), and supply a flavoring solution for secondary flavoring (top flavoring) onto the initial reconstituted tobacco sheet 801 using the flavoring apparatus 820, thereby preventing the material for secondary flavoring (top flavoring) from being thermally deformed or lost.

In an exemplary embodiment, the flavoring apparatus 820 may be a flavoring nozzle. The flavoring nozzle may be positioned above or under the initial reconstituted tobacco sheet 801 and may spray the flavoring solution onto the initial reconstituted tobacco sheet 801 passing through the periphery of the flavoring nozzle. In another exemplary embodiment, the flavoring apparatus 820 may be a flavoring roller. The flavoring roller may be positioned above or under the initial reconstituted tobacco sheet 801 and may apply the flavoring solution onto the initial reconstituted tobacco sheet 801 passing through the periphery of the flavoring roller. In another exemplary embodiment, the flavoring apparatus 820 may include a flavoring nozzle positioned above the initial reconstituted tobacco sheet 810 and a flavoring roller positioned under the initial reconstituted tobacco sheet 801. In this case, the flavoring nozzle may spray the flavoring solution onto a top surface of the initial reconstituted tobacco sheet 801 passing under the flavoring nozzle, and the flavoring roller may apply the flavoring solution onto the bottom surface of the initial reconstituted tobacco sheet 801 passing above the flavoring roller.

Furthermore, the flavoring apparatus 820 may be provided as a plurality of flavoring apparatuses. In an exemplary embodiment, the plurality of flavoring apparatuses may be arranged in parallel in a direction in which the initial reconstituted tobacco sheet 801 is supplied. In this case, each of the plurality of flavoring apparatuses may supply different flavoring solutions to the initial reconstituted tobacco sheet 801. In another exemplary embodiment, the plurality of flavoring apparatuses may be arranged in parallel in a direction perpendicular to the direction in which the initial reconstituted tobacco sheet 801 is supplied. In this case, the flavoring solution may be supplied onto the initial reconstituted tobacco sheet 801 more uniformly using the plurality of flavoring apparatuses.

Figure 9:
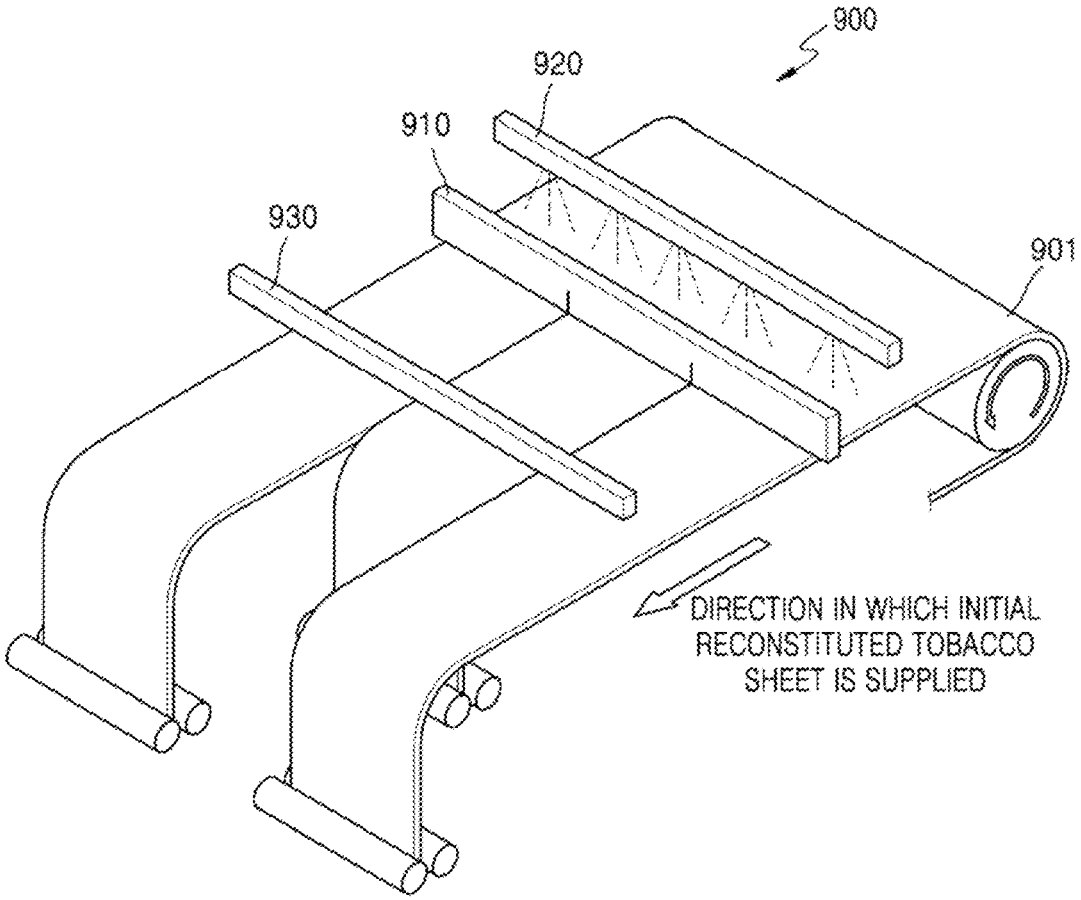
FIG. 9 is a diagram showing an apparatus for manufacturing reconstituted tobacco, wherein the apparatus includes a water supply nozzle and/or a dryer, according to an exemplary embodiment.

FIG. 9 is a diagram showing an apparatus for manufacturing reconstituted tobacco, which includes a water supply nozzle and/or a dryer, according to an exemplary embodiment.

An apparatus 900 for manufacturing cut reconstituted tobacco of FIG. 9 may include a feed roller, a primary cutter 910, a secondary cutter, and a tertiary cutter. Also, the apparatus 900 for manufacturing cut reconstituted tobacco may further include a flavoring apparatus. Details of the feed roller, the primary cutter 910, the secondary cutter, the tertiary cutter, and the flavoring apparatus are provided above with reference to FIGS. 5 through 8.

Referring to FIG. 9, the apparatus 900 for manufacturing cut reconstituted tobacco may supply an initial reconstituted tobacco sheet 901 to a conveyor unit. The apparatus 900 for manufacturing cut reconstituted tobacco may further include a measuring device for measuring the moisture of the initial reconstituted tobacco sheet 901.

The initial reconstituted tobacco sheet 901 may contain moisture corresponding to a certain percentage of a dry weight of the initial reconstituted tobacco sheet 901. In an exemplary embodiment, the moisture of the initial reconstituted tobacco sheet 901 may be about 7% to 15% of the dry weight of the initial reconstituted tobacco sheet 901. However, the moisture of the initial reconstituted tobacco sheet 901 is not limited thereto.

Moreover, the initial reconstituted tobacco sheet 901 may contain moisture that exceeds a target value or is below the target value. In an exemplary embodiment, the apparatus 900 for manufacturing cut reconstituted tobacco may include at least one of a water supply nozzle 920 for supplying moisture onto the initial reconstituted tobacco sheet 901 and a dryer 930 for drying the initial reconstituted tobacco sheet 901. The apparatus 900 for manufacturing cut reconstituted tobacco may adjust the moisture included in the initial reconstituted tobacco sheet 901 using at least one of the water supply nozzle 920 and the dryer 930.

In an exemplary embodiment, when the moisture is below the target value as a result of measuring the moisture of the initial reconstituted tobacco sheet 901 using the measuring device, the apparatus 900 for manufacturing cut reconstituted tobacco may supply water onto the initial reconstituted tobacco sheet 901 using the water supply nozzle 920. On the other hand, when the moisture of the initial reconstituted tobacco sheet 901 exceeds the target value, the apparatus 900 for manufacturing cut reconstituted tobacco may dry the initial reconstituted tobacco sheet 901 using the dryer 930.

Also, the apparatus 900 for manufacturing cut reconstituted tobacco may measure the moisture of the initial reconstituted tobacco sheet 901 using the measuring device in real time, and dynamically control the water supply nozzle 920 and the dryer 930 so that the moisture included in the initial reconstituted tobacco sheet 901 may be maintained at the target value.

Figure 10:
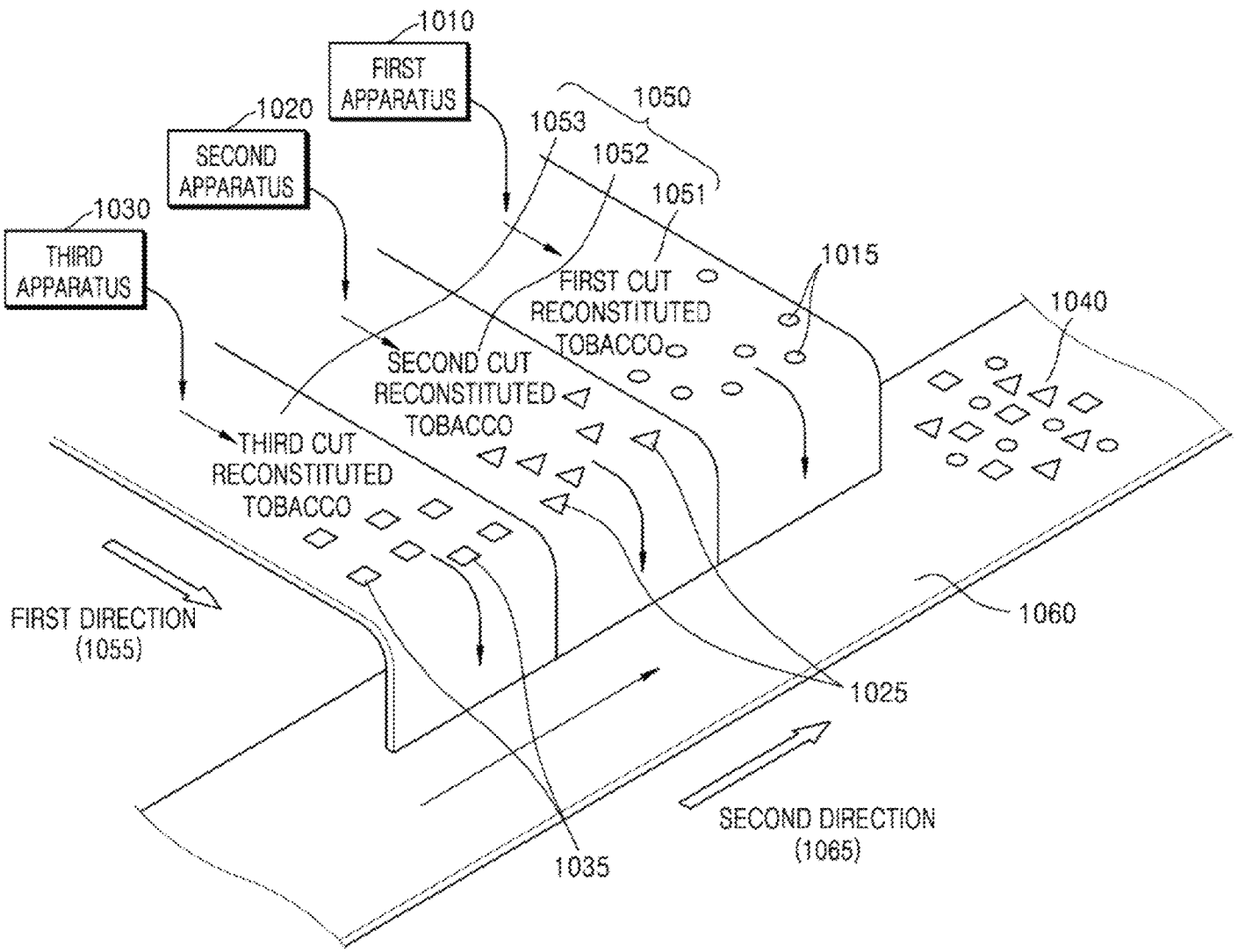
FIG. 10 is a diagram showing an example in which different types of cut reconstituted tobacco is manufactured and mixed with one another, according to an exemplary embodiment.

FIG. 10 is a diagram showing an example in which different types of cut reconstituted tobacco is manufactured and mixed with one another, according to an exemplary embodiment.

Referring to FIG. 10, a first apparatus 1010, a second apparatus 1020, and a third apparatus 1030 each represent the apparatus for manufacturing reconstituted tobacco described in FIGS. 5 through 9. That is, the first through third apparatuses 1010, 1020, and 1030 may perform a process of manufacturing cut reconstituted tobacco in a parallel manner.

In an exemplary embodiment, different types of initial reconstituted tobacco sheets may be supplied to the first through third apparatuses 1010, 1020, and 1030.

The type of the initial reconstituted tobacco sheet may be determined according to composing materials of the initial reconstituted tobacco sheet. In an exemplary embodiment, the type of the initial reconstituted tobacco sheet may be determined based on reducing sugar, total ammonia, and total alkaloids per dry weight. Total alkaloids may mean a small amount of alkaloids including nicotine, nornicotine, anatabin, anabacin, and myosmine.

A cut reconstituted tobacco mixing apparatus 1000 may mix first through third pieces of cut reconstituted tobaccos 1015, 1025, and 1035 manufactured from the first through third apparatuses 1010, 1020, and 1030, thereby manufacturing mixed cut reconstituted tobaccos 1040. The first through third pieces of cut reconstituted tobaccos 1015, 1025, and 1035 may be manufactured from different types of initial reconstituted tobacco sheets.

In detail, each of the first through third pieces of cut reconstituted tobaccos 1015, 1025, and 1035 manufactured from the first through third apparatuses 1010, 1020, and 1030 may be seated on a first conveyor unit 1050 that moves in a first direction 1055. The first through third pieces of cut reconstituted tobaccos 1015, 1025, and 1035 seated on the first conveyor unit 1050 may be moved by a certain distance and then may be seated on a second conveyor unit 1060 that moves in a second direction 1065 perpendicular to the first direction 1055.

Referring to FIG. 10, as the second conveyor unit 1060 moves in the second direction 1065, the third cut reconstituted tobacco 1035, the second cut reconstituted tobacco 1025, and the first cut reconstituted tobacco 1015 may be sequentially seated on the second conveyor unit 1060. That is, when the first through third pieces of cut reconstituted tobaccos 1015, 1025, and 1035 are seated on the second conveyor unit 1060 from the first conveyor unit 1050, the first through third pieces of cut reconstituted tobaccos 1015, 1025, and 1035 may be mixed with one another so that the mixed cut reconstituted tobacco 1040 may be manufactured.

In an exemplary embodiment, the mixture ratio of the first through third pieces of cut reconstituted tobaccos 1015, 1025, and 1035 may be determined according to the speeds of the (1-1) through (1-3) conveyor units (1051 through 1053). Also, the mixture ratio of the first through third pieces of cut reconstituted tobaccos 1015, 1025, and 1035 may be determined according to speeds at which the first through third pieces of cut reconstituted tobaccos 1015, 1025, and 1035 are dispensed from the first through third apparatuses 1010, 1020, and 1030, respectively.

For example, in order to manufacture the mixed cut reconstituted tobacco 1040 having certain characteristics (for example, reducing sugars of 10% of total dry weight), the speeds of the (1-1) and (1-2) conveyor units (1051 and 1052) may be set to 3 cm/sec, and the speed of the (1-3) conveyor unit 1053 may be set to 1 cm/sec.

On the other hand, the cut reconstituted tobacco mixing apparatus 1000 may dispense the first through third pieces of cut reconstituted tobaccos 1015, 1025, and 1035 manufactured from the first through third apparatuses 1010, 1020, and 1030 in the same location so that the first through third pieces of cut reconstituted tobaccos 1015, 1025, and 1035 may also be mixed. In this case, the mixture ratio of the first through third pieces of cut reconstituted tobaccos 1015, 1025, and 1035 may be determined according to speeds at which the first through third pieces of cut reconstituted tobaccos 1015, 1025, and 1035 are dispensed from the first through third apparatuses 1010, 1020, and 1030.

The cut reconstituted tobacco mixing apparatus 1000 according to the present exemplary embodiment may mix a plurality of pieces of cut reconstituted tobaccos 1015, 1025, and 1035 without using an additional blending device. The cut reconstituted tobacco mixing apparatus 1000 may dispense the plurality of pieces of cut reconstituted tobaccos 1015, 1025, and 1035 manufactured from the plurality of apparatuses 1010, 1020, and 1030 for manufacturing cut reconstituted tobacco in the same location, or mix the plurality of pieces of cut reconstituted tobaccos 1015, 1025, and 1035 using a plurality of conveyor units having different moving directions.

Furthermore, the cut reconstituted tobacco mixing apparatus 1000 may control at least one of the speed of a conveyor unit and/or dispensing speeds of the plurality of pieces of cut reconstituted tobaccos 1015, 1025, and 1035 so as to determine a mixture ratio of the plurality of pieces of cut reconstituted tobaccos 1015, 1025, and 1035, thereby manufacturing the mixed cut reconstituted tobacco 1040 having desired characteristics.

Figure 11:
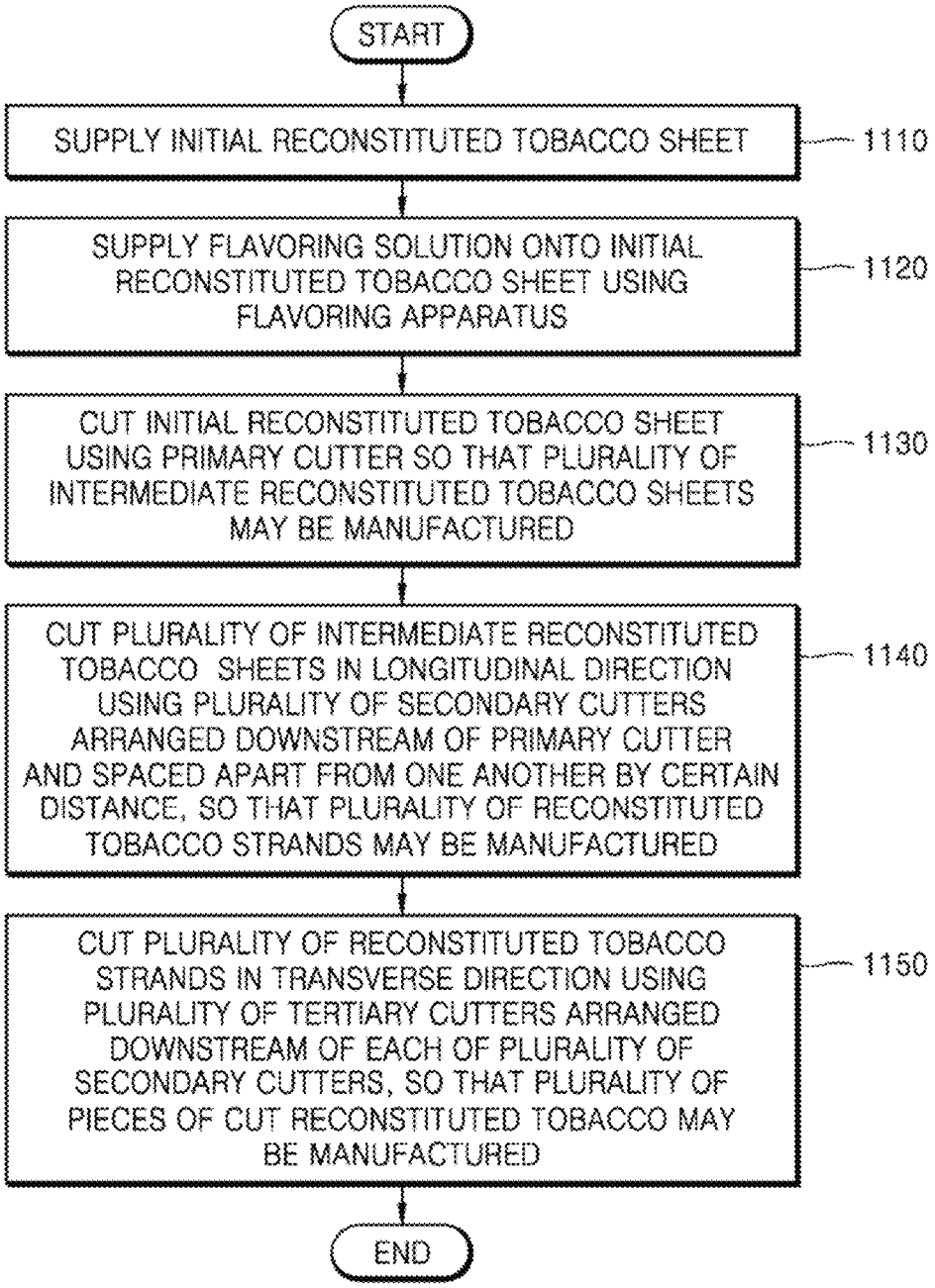
FIG. 11 is a flowchart illustrating a method of manufacturing cut reconstituted tobacco according to an exemplary embodiment.

FIG. 11 is a flowchart illustrating a method of manufacturing cut reconstituted tobacco according to an exemplary embodiment.

Referring to FIG. 11, in Operation 1110, an apparatus for manufacturing cut reconstituted tobacco may supply an initial reconstituted tobacco sheet. In an exemplary embodiment, the apparatus for manufacturing cut reconstituted tobacco may supply the initial reconstituted tobacco sheet to a conveyor unit using a feed roller.

In Operation 1120, the apparatus for manufacturing cut reconstituted tobacco may supply a flavoring solution onto the initial reconstituted tobacco sheet using a flavoring apparatus.

The apparatus for manufacturing cut reconstituted tobacco may be configured to receive the initial reconstituted tobacco sheet that is primary flavored (casing), from the feed roller. The apparatus for manufacturing cut reconstituted tobacco may be configured to supply the flavoring solution for secondary flavoring (top flavoring) onto the initial reconstituted tobacco sheet using the flavoring apparatus located downstream of the feed roller.

In an exemplary embodiment, the flavoring apparatus may be a flavoring nozzle. The flavoring nozzle may be located above or under the initial reconstituted tobacco sheet and may spray the flavoring solution onto the initial reconstituted tobacco sheet passing through the periphery of the flavoring nozzle. Alternatively, the flavoring apparatus may be a flavoring roller. The flavoring roller may be located above or under the initial reconstituted tobacco sheet and may apply the flavoring solution onto the initial reconstituted tobacco sheet passing through the periphery of the flavoring roller. Alternatively, the flavoring apparatus may include a flavoring nozzle located above the initial reconstituted tobacco sheet and a flavoring roller located under the initial reconstituted tobacco sheet. In this case, the flavoring apparatus may spray the flavoring solution onto a top surface of the initial reconstituted tobacco sheet passing under the flavoring nozzle and may apply the flavoring solution onto a bottom surface of the initial reconstituted tobacco sheet passing over the flavoring roller.

Also, the flavoring apparatus may be provided as a plurality of flavoring apparatuses. In an exemplary embodiment, the plurality of flavoring apparatuses may be arranged in parallel in a direction in which the initial reconstituted tobacco sheet is supplied. In this case, each of the plurality of flavoring apparatuses may supply different flavoring solutions to the initial reconstituted tobacco sheet. In another exemplary embodiment, the plurality of flavoring apparatuses may be arranged in parallel in a direction perpendicular to the direction in which the initial reconstituted tobacco sheet is supplied. In this case, the flavoring solution may be supplied onto the initial reconstituted tobacco sheet more uniformly using the plurality of flavoring apparatuses.

On the other hand, the apparatus for manufacturing cut reconstituted tobacco may supply the flavoring solution onto the initial reconstituted tobacco sheet using the flavoring apparatus before the initial reconstituted tobacco sheet is cut into a plurality of intermediate reconstituted tobacco sheets by a primary cutter.

In Operation 1130, the apparatus for manufacturing cut reconstituted tobacco may be configured to cut the initial reconstituted tobacco sheet using the primary cutter, thereby manufacturing the plurality of intermediate reconstituted tobacco sheets.

The initial reconstituted tobacco sheet injected into the primary cutter may be cut into a certain number of intermediate reconstituted tobacco sheets. In an exemplary embodiment, the primary cutter may include two rollers that face each other. The two rollers may be rotated in opposite directions so that the initial reconstituted tobacco sheet injected into the primary cutter may pass through the primary cutter. Also, a plurality of cutting blades may be arranged on an outer circumferential surface of each of the rollers. That is, the initial reconstituted tobacco sheet may pass through the primary cutter, may be cut by the plurality of cutting blades and thus may be manufactured of a plurality of intermediate reconstituted tobacco sheets.

In Operation 1140, the apparatus for manufacturing cut reconstituted tobacco may be configured to cut the plurality of intermediate reconstituted tobacco sheets in a longitudinal direction using a plurality of secondary cutters that are located downstream of the primary cutter and spaced apart from one another by a certain distance, so that a plurality of reconstituted tobacco strands may be manufactured.

In an exemplary embodiment, the plurality of secondary cutters may be arranged in parallel with one another based on the primary cutter, in a stepped manner, or in a zigzag manner. Each of the intermediate reconstituted tobacco sheets may be manufactured of a plurality of reconstituted tobacco strands based on cut specifications set in the secondary cutters. In an exemplary embodiment, the cut specifications that may be set in the secondary cutters may be the number of reconstituted tobacco strands, but is not limited thereto.

Moreover, the apparatus for manufacturing cut reconstituted tobacco may further include a defect detection device that may determine whether there is any defect in each of the secondary cutters. When it is determined by the defect detection device that some of the secondary cutters have a defect, the apparatus for manufacturing cut reconstituted tobacco may prevent the intermediate reconstituted tobacco sheet from being fed into the secondary cutters which have a defect.

In an exemplary embodiment, the apparatus for manufacturing cut reconstituted tobacco may stop the operation of the secondary conveyor unit that moves the intermediate reconstituted tobacco sheet to the second cutters which have a defect. Alternatively, the apparatus for manufacturing cut reconstituted tobacco may further include a bypass conveyor unit. The bypass conveyor unit may detour the intermediate reconstituted tobacco sheet to bypass the secondary cutters which have a defect.

In Operation 1150, the apparatus for manufacturing cut reconstituted tobacco may be configured to cut a plurality of reconstituted tobacco strands in the transverse direction using a plurality of tertiary cutters arranged downstream of each of the plurality of secondary cutters, so that a plurality of pieces of cut reconstituted tobaccos may be manufactured.

The plurality of tertiary cutters may be spaced apart from the secondary cutters by a certain distance. The plurality of reconstituted tobacco strands may be cut into a plurality of pieces of cut reconstituted tobaccos based on the cut specification defined in the tertiary cutters.

Moreover, a process of manufacturing cut reconstituted tobacco may be performed in a parallel manner using a plurality of apparatuses for manufacturing cut reconstituted tobacco. In an exemplary embodiment, different types of initial reconstituted tobacco sheets may be supplied to the plurality of apparatuses for manufacturing cut reconstituted tobacco. In this case, different types of cut reconstituted tobacco manufactured from the plurality of apparatuses for manufacturing cut reconstituted tobacco are mixed with each other so that mixed cut reconstituted tobacco may be manufactured.

Those of ordinary skill in the art related to the present exemplary embodiments may understand that various changes in form and details can be made therein without departing from the scope of the characteristics described above. The disclosed methods should be considered in a descriptive sense only and not for purposes of limitation. The scope of the present disclosure is defined not in the above description but in the claims, and all differences within an equivalent scope thereto should be interpreted to be included in the present disclosure.

What is claimed is:

1. An apparatus for manufacturing cut reconstituted tobacco, the apparatus comprising:

a feed roller configured to supply an initial reconstituted tobacco sheet to a conveyor unit;

a flavoring apparatus configured to supply a flavoring solution onto the initial reconstituted tobacco sheet;

a primary cutter configured to manufacture a plurality of intermediate reconstituted tobacco sheets by cutting through the initial reconstituted tobacco sheet supplied with the flavoring solution using the flavoring apparatus in a longitudinal direction;

a plurality of secondary cutters arranged downstream of the primary cutter, spaced apart from one another by a certain distance, and configured to manufacture a plurality of reconstituted tobacco strands by cutting through the plurality of intermediate reconstituted tobacco sheets in the longitudinal direction; and a plurality of tertiary cutters arranged downstream of each of the plurality of secondary cutters and configured to manufacture a plurality of pieces of cut reconstituted tobacco by cutting through the plurality of reconstituted tobacco strands in a transverse direction.

2. The apparatus of claim 1, wherein the flavoring apparatus comprises a flavoring nozzle located above or under the initial reconstituted tobacco sheet and configured to spray the flavoring solution onto the initial reconstituted tobacco sheet passing through a periphery of the flavoring nozzle.

3. The apparatus of claim 1, wherein the flavoring apparatus comprises a flavoring roller located above or under the initial reconstituted tobacco sheet and configured to apply the flavoring solution onto the initial reconstituted tobacco sheet passing through the periphery of the flavoring roller.

4. The apparatus of claim 1, wherein the flavoring apparatus comprises:

a flavoring nozzle located above the initial reconstituted tobacco sheet and configured to spray the flavoring solution onto a top surface of the initial reconstituted tobacco sheet passing under the flavoring nozzle; and a flavoring roller located under the initial reconstituted tobacco sheet, and configured to apply the flavoring solution onto a bottom surface of the initial reconstituted tobacco sheet passing above the flavoring roller.

5. The apparatus of claim 1, wherein the flavoring apparatus is provided as a plurality of flavoring apparatuses, the plurality of flavoring apparatuses are arranged in parallel in a direction in which the initial reconstituted tobacco sheet is supplied, and the plurality of flavoring apparatuses supply different flavoring solutions onto the initial reconstituted tobacco sheet.

6. The apparatus of claim 1, wherein the flavoring apparatus is provided as a plurality of flavoring apparatuses, and the plurality of flavoring apparatuses are arranged in parallel in a direction perpendicular to a direction in which the initial reconstituted tobacco sheet is supplied, and supply the flavoring solution onto the initial reconstituted tobacco sheet using the plurality of flavoring apparatuses.

7. The apparatus of claim 1, wherein the initial reconstituted tobacco sheet is primary flavored (casing), and the flavoring apparatus supplies the flavoring solution for secondary flavoring (top flavoring) onto the initial reconstituted tobacco sheet.

8. The apparatus of claim 1, further comprising a bypass conveyor unit configured to, based on determining that at least one secondary cutter of the plurality of secondary cutters has a defect, detour the plurality of intermediate reconstituted tobacco sheets to bypass the at least one secondary cutter.

9. The apparatus of claim 1, further comprising:

a measuring device configured to measure moisture included in the initial reconstituted tobacco sheet; and a water supply nozzle configured to supply moisture onto the initial reconstituted tobacco sheet based on the measured moisture.

10. The apparatus of claim 1, further comprising:

a measuring device configured to measure moisture included in the initial reconstituted tobacco sheet; and a dryer configured to dry the initial reconstituted tobacco sheet based on the measured moisture content.

* * * * *